US009528220B2

(12) United States Patent
Dierker

(10) Patent No.: US 9,528,220 B2
(45) Date of Patent: Dec. 27, 2016

(54) CONVERTIBLE IRON

(71) Applicant: COLLAR PERFECT, LLC, Charlotte, NC (US)

(72) Inventor: Brandon Dierker, Charlotte, NC (US)

(73) Assignee: Collar Perfect, LLC, Charlotte, NC (US)

( * ) Notice: Subject to any disclaimer, the term of this patent is extended or adjusted under 35 U.S.C. 154(b) by 0 days.

(21) Appl. No.: 14/618,549

(22) Filed: Feb. 10, 2015

(65) Prior Publication Data

US 2015/0233045 A1 Aug. 20, 2015

Related U.S. Application Data

(63) Continuation-in-part of application No. 29/503,839, filed on Sep. 30, 2014, now Pat. No. Des. 728,885.
(Continued)

(51) Int. Cl.
*D06F 75/30* (2006.01)
*D06F 75/24* (2006.01)
*D06F 75/38* (2006.01)

(52) U.S. Cl.
CPC ..... *D06F 75/30* (2013.01); *D06F 75/24* (2013.01); *D06F 75/38* (2013.01); *Y10T 29/49002* (2015.01)

(58) Field of Classification Search
CPC ..... D06F 75/18; D06F 75/20; D06F 75/24; D06F 75/30; D06F 75/38; D06F 71/36; A47G 25/72; H05B 1/0255; A45D 4/06; A45D 4/12; Y10T 29/49002
See application file for complete search history.

(56) References Cited

U.S. PATENT DOCUMENTS 1,047,218 A 12/1912 Hatler
1,350,583 A 8/1920 Willey
(Continued)

FOREIGN PATENT DOCUMENTS

JP 3-188900 A 8/1991
KR WO2014129685 A1 * 8/2014
(Continued)

OTHER PUBLICATIONS

International Search Report and Written Opinion from International Application No. PCT/US2015/015211 dated May 14, 2015.
(Continued)

*Primary Examiner* — Ismael Izaguirre
(74) *Attorney, Agent, or Firm* — Alston & Bird LLP

(57) ABSTRACT

Provided herein are a convertible iron and methods of manufacturing and converting the same. The iron may include a first adjustable wing and a second adjustable wing joined to a pivoting hub, such that the adjustable wings are configured to pivot about the hub with respect to each other. The iron may include a heating plate connected to at least the first adjustable wing. At least a portion of each adjustable wing may be configured to rotate between a detailing position and an ironing position. In the detailing position, the portions of each adjustable wing may be substantially parallel, such that the adjustable wings are substantially opposing one another and may be configured to receive an article therebetween for ironing. In the ironing position, the portions of each adjustable wing may be substantially coplanar and may be configured to engage a same side of a surface of an article for ironing.

23 Claims, 15 Drawing Sheets

Related U.S. Application Data

(60) Provisional application No. 61/941,827, filed on Feb. 19, 2014.

(56) References Cited

U.S. PATENT DOCUMENTS

| | | | | |
|---|---|---|---|---|
| 1,667,286 | A | 4/1928 | Clisson | |
| 1,691,106 | A | 11/1928 | Benjamin | |
| 1,959,626 | A | 5/1934 | Huebsch | |
| 1,996,548 | A | 4/1935 | McEwen | |
| 2,051,854 | A | 8/1936 | Holloway | |
| 2,055,824 | A | 9/1936 | Mall | |
| 2,059,295 | A | 11/1936 | Wilhelm | |
| 2,065,366 | A * | 12/1936 | Eichorn | D06F 75/38 219/254 |
| 2,147,597 | A | 2/1939 | Long | |
| 2,192,786 | A | 3/1940 | Campbell | |
| 2,196,810 | A | 4/1940 | Hoch | |
| 2,254,653 | A | 9/1941 | Hoch | |
| 2,469,226 | A | 5/1949 | Forse | |
| 2,470,516 | A | 5/1949 | Neckel | |
| 2,483,812 | A | 10/1949 | Davis et al. | |
| D169,296 | S | 4/1953 | Victor | |
| 2,769,585 | A | 11/1956 | Goldstein | |
| 2,792,977 | A * | 5/1957 | Klein | D06F 75/38 223/36 |
| 2,829,809 | A | 4/1958 | Freeman | |
| 2,886,221 | A | 5/1959 | Todd | |
| 3,586,219 | A | 6/1971 | Radford et al. | |
| 3,901,420 | A | 8/1975 | Revuelta | |
| D247,544 | S | 3/1978 | Gustavsson | |
| 4,427,139 | A | 1/1984 | Depriest | |
| 4,845,868 | A * | 7/1989 | Tierney | A47G 25/72 38/71 |
| 4,890,401 | A | 1/1990 | Weisfeld | |
| D349,378 | S | 8/1994 | Simmon | |
| D360,509 | S | 7/1995 | Maeda et al. | |
| 5,553,410 | A | 9/1996 | Derby | |
| 6,301,712 | B1 | 10/2001 | Miyata | |
| 6,324,776 | B1 | 12/2001 | Miyata | |
| 6,386,206 | B2 * | 5/2002 | Lee | A45D 1/04 132/225 |
| 6,497,060 | B1 | 12/2002 | Bolan, Jr. et al. | |
| D510,584 | S | 10/2005 | Tierney | |
| 7,000,340 | B1 | 2/2006 | Uchikoshi | |
| 7,121,024 | B1 * | 10/2006 | Clevenberg | D06F 71/02 38/25 |
| D531,774 | S | 11/2006 | Grossi | |
| D608,350 | S | 1/2010 | Bo | |
| 7,838,798 | B2 | 11/2010 | Uchikoshi | |
| D646,259 | S | 10/2011 | Daniel | |
| D653,415 | S | 1/2012 | Zegdon | |
| D663,087 | S | 7/2012 | Grossi | |
| D669,894 | S | 10/2012 | Cobbett et al. | |
| D670,696 | S | 11/2012 | Cobbett et al. | |
| 8,578,639 | B2 | 11/2013 | Hurd | |
| D696,223 | S | 12/2013 | Will et al. | |
| 8,789,539 | B2 * | 7/2014 | Linglin | A45D 1/04 132/224 |
| D710,230 | S | 8/2014 | Burke | |
| 2009/0223097 | A1 | 9/2009 | Lee | |
| 2012/0102793 | A1 | 5/2012 | Harrington | |

FOREIGN PATENT DOCUMENTS

| | | | |
|---|---|---|---|
| WO | WO 2013/077608 A1 | | 5/2013 |
| WO | WO2015106054 | * | 7/2015 |

OTHER PUBLICATIONS

How to Iron Your Clothes with a Hair Straightener [online] [retrieved Jan. 24, 2014]. Retrieved from the Internet: <URL: http://www.apartmenttherapy.com/how-to-iron-your-clothes-with-a-hair-straightener-175398>. 3 pages.

Hackanator: Hair Straighteners Make for Great Shirt Collar Irons [online] [retrieved Jan. 24, 2014]. Retrieved from the Internet: <URL: https://twitter.com/intent/tweet?text=Hair_Straighteners_Make_For_Great...>. (Dated Sep. 2013) 5 pages.

Quick Tip: Iron a Shirt Collar [online] [retrieved Jan. 24, 2014]. Retrieved from the Internet: <URL: http://www.adoseofpaige.com/2013/07/quick-tip-iron-a-shirt-collar/>. 7 pages.

Propaganda Sifter; How to Iron a Shirt Collars with a Hair Straightener [online] [retrieved Jan. 24, 2014]. Retrieved from the Internet: <URL: http://www.apartmenttherapy.com/how-to-iron-your-clothes-with-a-hair-straightener-175398>. (Dated Oct. 26, 2006); 1 page.

MacGyver Tip: Iron Shirt Collars with a Hair Straightener [online] [retrieved Jan. 24, 2014]. Retrieved from the Internet: <URL: http://lifehacker.com/210084/macgyver-tip-iron-shirt-collars-with-a-hair-straightener>. 2 pages.

Iron a Shirt Collar with a Hair Straightener [online] [retrieved Jan. 24, 2014]. Retrieved from the Internet: <URL: http://www.pinterest.com/pin/556546466421659515/>. 2 pages.

Koizumi T-iron [little bit across easy ironing at] portable steam iron black KAS-3000 / K [online] [retrieved Apr. 16, 2015]. Retrieved from the Internet: <URL: http://translate.google.com/translate?hl=en&sl=ja&u=http://www.amazon.co.jp/KOISUMI . . . >. 1 page.

* cited by examiner

CONVERTIBLE IRON

CROSS-REFERENCE TO RELATED APPLICATIONS

This application claims priority to U.S. Design Application No. 29/503,839, which is entitled "Adjustable Iron" and was filed Sep. 30, 2014, and also claims priority to U.S. Provisional Application No. 61/941,827, which is entitled "Adjustable Shirt Collar Iron" and was filed Feb. 19, 2014, which references are hereby incorporated by reference in their entireties.

FIELD OF THE INVENTION

The present invention generally relates to irons and ironing solutions for smoothing imperfections in garments and other articles.

BACKGROUND OF THE INVENTION

Irons are traditionally used to straighten or flatten a wrinkled or misshaped garment. Household irons are large, heavy devices that use a heating surface to smooth imperfections in garments. These devices often require long setup and teardown times to allow the heating element to reach operating temperature and then to cool back down after use. Traditional irons also have a heating element that is unshielded and uncovered, which requires constant monitoring during the cooling process.

Traditional irons may require an ironing board or other large, flat surface on which to iron the garments, which require additional storage space and setup time. While useful for large ironing projects, these types of irons are incapable of quickly touching-up a garment without the wearer first removing the garment and setting up the iron and ironing board.

Applicant has identified a number of deficiencies and problems associated with conventional ironing technologies. Through applied effort, ingenuity, and innovation, many of these identified problems have been solved by developing solutions that are included in embodiments of the present invention, many examples of which are described in detail herein.

BRIEF SUMMARY OF THE INVENTION

In general, embodiments of the present invention provided herein include apparatus and methods of using and manufacturing a convertible iron.

In some embodiments, a convertible iron may be provided including a first adjustable wing and a second adjustable wing, a pivoting hub, and a heating plate connected to at least the first adjustable wing. Each of the adjustable wings may be joined to the pivoting hub, and the adjustable wings may be configured to pivot about the hub and with respect to each other. At least a portion of each adjustable wing may be configured to rotate between a detailing position and an ironing position. In the detailing position, the portions of each adjustable wing may be substantially parallel, such that the adjustable wings may be substantially opposing one another and may be configured to receive an article therebetween for ironing. In the ironing position, the portions of each adjustable wing are substantially coplanar and are configured to engage a same side of a surface of an article for ironing.

In some embodiments, at least the first adjustable wing may include an upper portion and a lower portion. The lower portion may be the portion of the first adjustable wing that may be configured to rotate between the detailing position and the ironing position. In some embodiments of the ironing position, the lower portion of the first adjustable wing may be disposed perpendicular to the respective upper portion of the first adjustable wing. In some embodiments of the detailing position, the lower portion of the first adjustable wing is collinear with the respective upper portion of the first adjustable wing.

Some embodiments of the convertible iron may include a hinge connecting the upper portion and lower portion of the first adjustable wing. The hinge may be a two-position hinge adapted to allow a user to rotate the lower portion of the first adjustable wing between the detailing position and the ironing position.

In some embodiments, the heating plate may be disposed in the lower portion of the first adjustable wing. The convertible iron may further include a second heating plate disposed in the second adjustable wing. Each heating plate may include a conductive plate and a heating element attached to the conductive plate. Some embodiments of the convertible iron may include at least one spring connecting each heating plate to the respective adjustable wing, such that the springs are configured to support each heating plate. The heating plate may be substantially free floating within each respective wing, such that the heating plates may be configured to conform to a contoured surface of the article.

Some embodiments of the convertible iron may include an actuator connected to the heating plates, configured to be actuated by a user, and configured to select from a plurality of temperature settings of the heating plates.

A distal end of the first adjustable wing may include a chamfer configured to guide uneven surfaces towards the heating plate. The convertible iron may further include a heat shield disposed opposite the heating plate on the first adjustable wing. In some embodiments, the adjustable wings may be configured to pivot at least twelve degrees about the hub.

Some embodiments may include a method of manufacturing a convertible iron. The method may include providing a first adjustable wing, a second adjustable wing, and a pivoting hub. Some embodiments of the method include joining the first adjustable wing and the second adjustable wing to the pivoting hub. The first and second adjustable wings may be configured to pivot about the hub and with respect to each other. The method may further include positioning a heating plate in at least the first adjustable wing. At least a portion of each adjustable wing may be configured to rotate between a detailing position and an ironing position. In some embodiments of the detailing position, the portions of each adjustable wing are substantially parallel, such that the adjustable wings are substantially opposing one another and are configured to receive an article therebetween for ironing. In some embodiments of the ironing position, the portions of each adjustable wing are substantially coplanar and are configured to iron a surface of the article.

In some embodiments, providing the first adjustable wing may include pivotally connecting an upper portion of the first adjustable wing and a lower portion of the first adjustable wing, wherein the lower portion is the portion of the first adjustable wing that is configured to rotate between the detailing position and the ironing position.

The method of manufacturing may further include attaching the heating plate to the first adjustable wing with at least one spring connection, such that the at least one spring connection is configured to support the heating plate.

In yet another embodiment of the present invention, a method of converting a convertible iron may be provided. The convertible iron may include a first adjustable wing; a second adjustable wing; a pivoting hub, wherein each of the adjustable wings is joined to the pivoting hub, the adjustable wings being configured to pivot about the hub and with respect to each other; and a heating plate connected to at least the first adjustable wing. The method may include rotating at least a portion of each adjustable wing between a detailing position and an ironing position. In some embodiments of the detailing position, the portions of each adjustable wing are substantially parallel, such that the adjustable wings are substantially opposing one another and are configured to receive an article therebetween for ironing. In some embodiments of the ironing position, the portions of each adjustable wing are substantially coplanar and are configured to engage a same side of a surface of an article for ironing.

In some embodiments of the method of converting the convertible iron, at least the first adjustable wing comprises an upper portion and a lower portion. Rotating at least a portion of the first adjustable wing between the detailing position and the ironing position may include rotating the lower portion with respect to the upper portion.

BRIEF DESCRIPTION OF THE DRAWINGS

Reference will now be made to the accompanying drawings, which are not necessarily drawn to scale, and wherein.

DETAILED DESCRIPTION OF THE INVENTION

The present invention will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. The terms top, bottom, side, up, down, upwards, downwards, vertical, horizontal, and the like as used below do not imply a required limitation in all embodiments of the present invention but rather are used herein to help describe relative direction or orientation in the example embodiments illustrated in the figures. The drawings may omit illustration of certain heating materials, padding, insulation, and other coverings to facilitate ease of visibility and understanding of features of the invention. As used in the specification and in any appended claims, the singular forms "a", "an", and "the" include plural referents unless the context clearly indicates otherwise.

As used herein, the term "substantially" is meant to encompass the described term and reasonable engineering variances thereof, within the scope of the described feature. For example, when the heating plates are described as being "substantially coplanar," the plates may be generally within the same plane as one another, but minor deviations such as one plate being deflected by a button or wrinkle, will not cease to make them coplanar. Similarly, when the wings are described as "substantially parallel," the wings may be generally parallel to one another, but may be slightly skewed from parallel depending on the thickness of the heating plates and/or garment being ironed and the wings' relative position on the hub.

Embodiments of the present invention are directed toward a convertible iron and methods of assembling the same. The iron may be converted from a configuration similar to a traditional iron, in an ironing position, to a compact, detailing iron in a detailing position by rotating one or more heating plates between the two positions. In the ironing position, the heating plates of the convertible iron may be substantially coplanar so as to define a larger, combined ironing surface, which may be used in a similar fashion to a traditional iron. In the detailing position, the heating plates of the convertible iron may opposingly face one another, such that garments or other articles may be ironed between the heating plates without requiring an external surface on which to rest the garment and iron.

Figure 1:
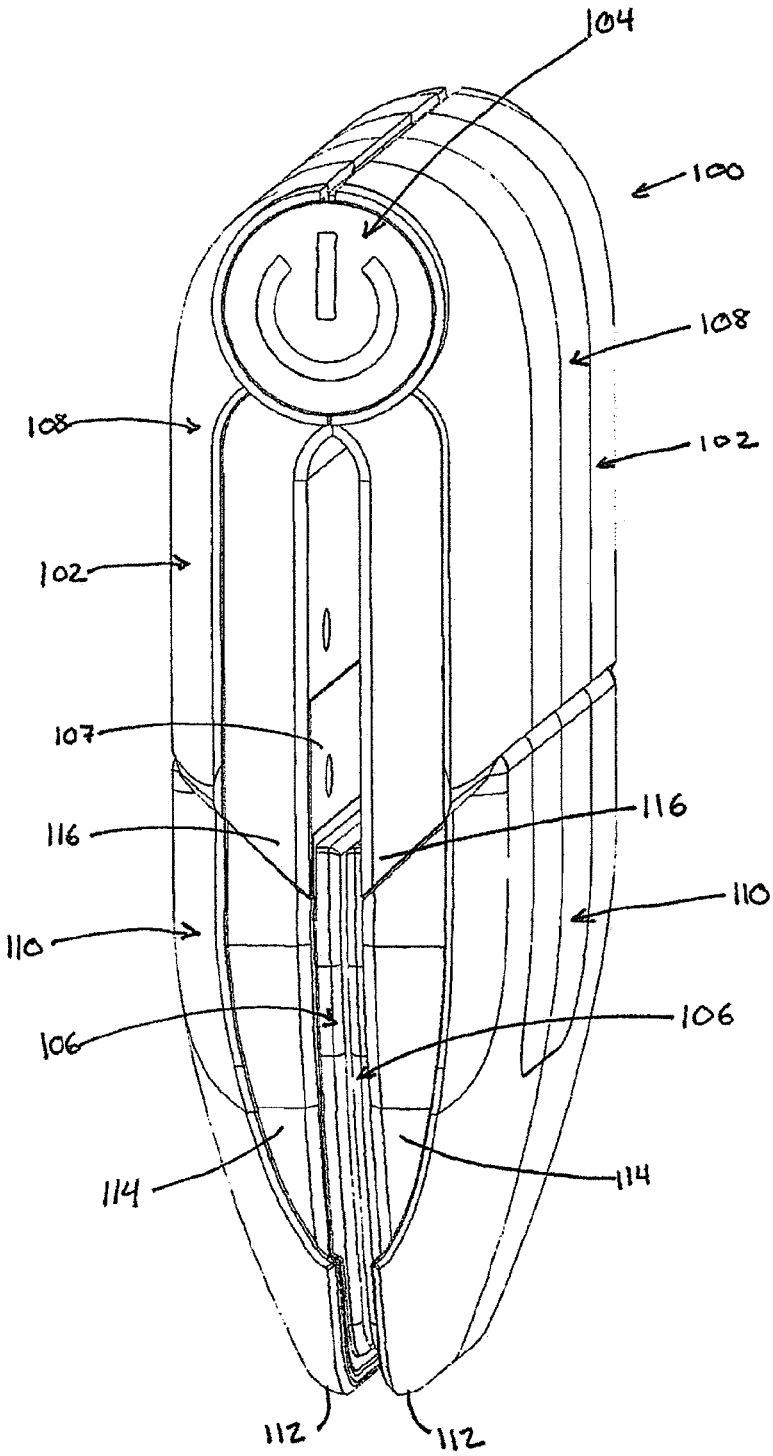
FIG. 1 shows a perspective view an embodiment of the present invention in a detailing position in accordance with an embodiment of the present invention.
Figure 2:
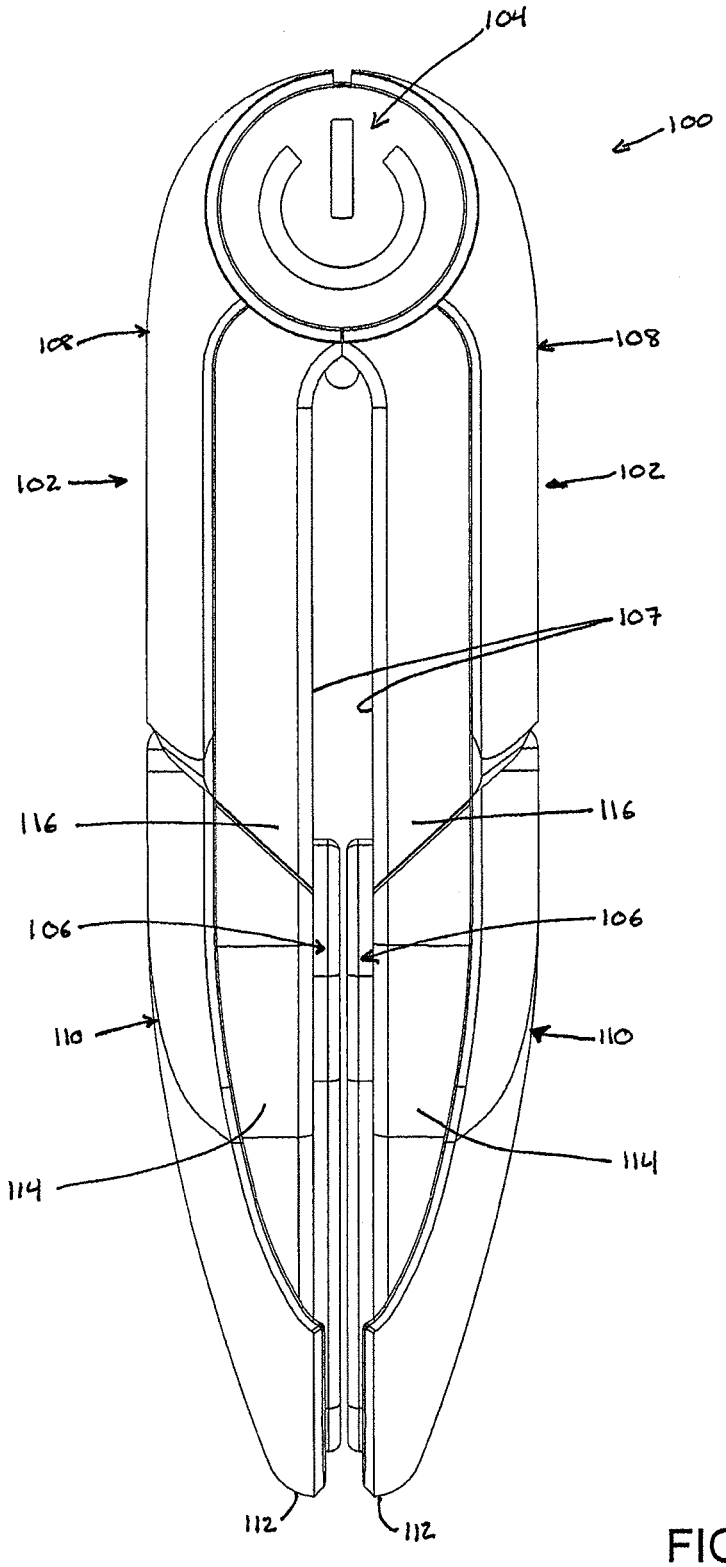
FIG. 2 shows a side view of the embodiment of FIG. 1 in accordance with an embodiment of the present invention.
Figure 6:
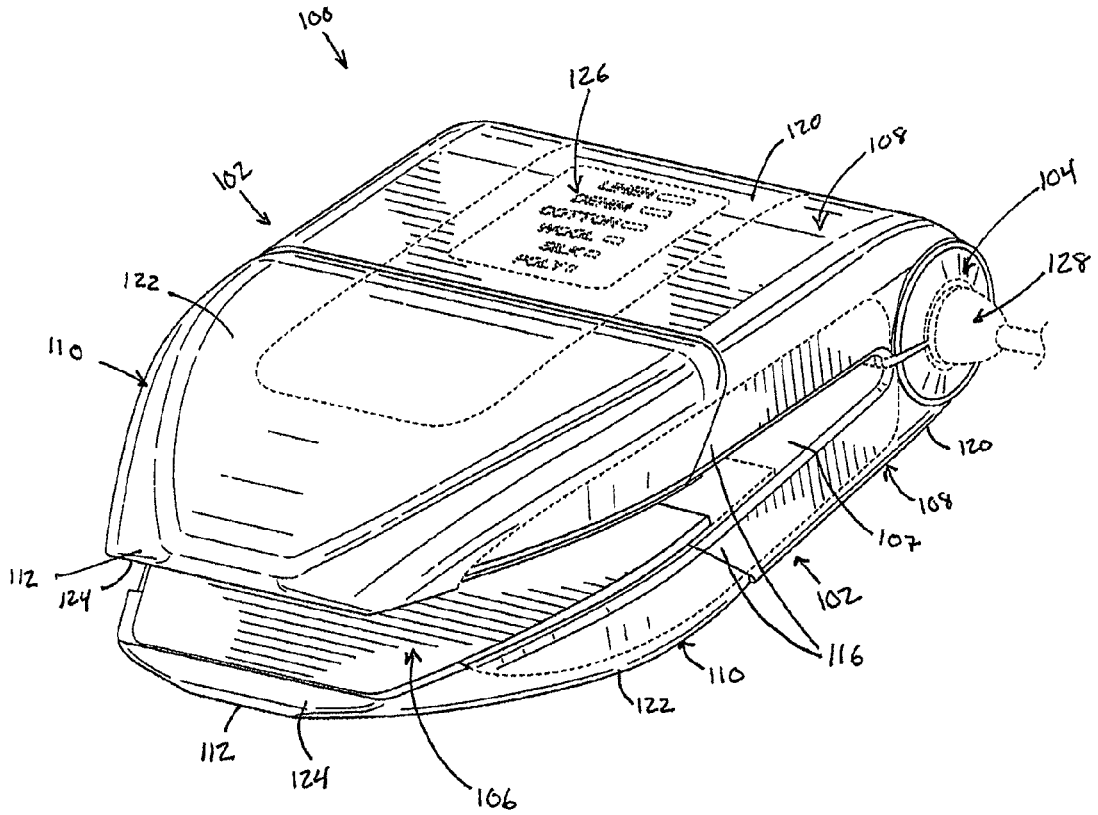
FIG. 6 shows a perspective view of an embodiment of the present invention in a detailing position and having the wings open in accordance with an embodiment of the present invention.

FIGS. 1-2 show an embodiment of the convertible iron 100 in a detailing position. The convertible iron 100 may include a pair of wings 102 attached at a hub 104. The wings 102 may at least partially pivot about the hub 104 in a clamshell-like motion to allow the convertible iron 100 to open and close to pinch a garment or other article between the wings. In some embodiments, described in greater detail below, the hub 104 may include a hinge 132 (shown in FIG. 7) that pivotally connects the two wings 102 with one another. In some embodiments, the hub 104 may allow the wings 102 to pivot approximately twelve degrees apart to accommodate garments for ironing therebetween in the detailing position. Twelve degrees may correspond to approximately a one inch separation between the distal ends 112 of the wings 102. For example, FIG. 6 depicts an embodiment of the present invention having the wings 102 open in the detailing position. As discussed below, in other embodiments, the hub 104 may allow the wings 102 to separate by at least one hundred and eighty degrees such that the hub may instead convert the iron between the detailing and the ironing position.

In some embodiments, each of the wings 102 may have one or more heating plates 106 attached thereto. As described in further detail herein, the heating plates 106 may include elongate, conductive plates 146 that may be attached to and/or suspended in the wings 102. The heating plates 106 may project from the inner, ironing surfaces 107 of each wing 102 as shown in FIGS. 1-2, such that pinching the two wings together may cause the heating plates to apply pressure to one another. This counter pressure between the heating plates 106 combined with the applied heat from each plate may allow the convertible iron to smooth imperfections in a garment without needing an external surface to rest on.

Using the detailing mode, a user may iron wrinkles and smooth sections of a garment on a hanger or even while the garment is being worn. In the detailing mode, the user may apply pressure to the garments by mechanically squeezing the exterior housing of each wing 102 to press the heating plates 106 together with the garment therebetween. Alternatively, the heating plates may be disposed within the wings such that the heating plates transfer heat to the ironing surfaces of the convertible iron, but the heating plates do not necessarily project from the wings. In this embodiment, the convertible iron may still be used in the same manner described above.

The detailing position may also be a cooling or storage position, whereby the heating plates 106 and/or hot areas of the ironing surfaces 107 face each other to minimize their exposed surface area, which could accidentally contact a user or nearby surface. In this manner, a user may revert the convertible iron 100 to the detailed position when the device is cooling to reduce the risk of accidental burns or fire.

In some alternative embodiments, only one of the two wings 102 may include a heating plate 106, with the opposing wing including non-heating surface. In these embodiments, the non-heating surface may be used in mechanically the same way as the two heating plates 106 detailed herein by providing counter pressure to the opposing heating plate to pinch the garment or other article therebetween.

In some embodiments, each of the wings 102 of the convertible iron 100 may be made of two or more connected pieces, including an upper portion 108 and a lower portion 110. The upper portion 108 of each wing 102 may be pivotally connected to the lower portion 110, such that the lower portion can pivot about an axis joining the upper and lower portions. In some embodiments, the heating plates 106 of the respective wings 102 may be disposed in the lower portion 110 of each wing, so that each heating plate pivots with the respective lower portion. In some embodiments, the pivot between the upper 108 and lower portions 110 may have at least at 90 degree range of motion, such that the lower portions can pivot outwardly until they are approximately one hundred and eighty degrees apart. In such an embodiment, the lower portions 110 and heating plates 106 may be substantially coplanar, excluding any additional rotation from the hub 104.

Figure 3:
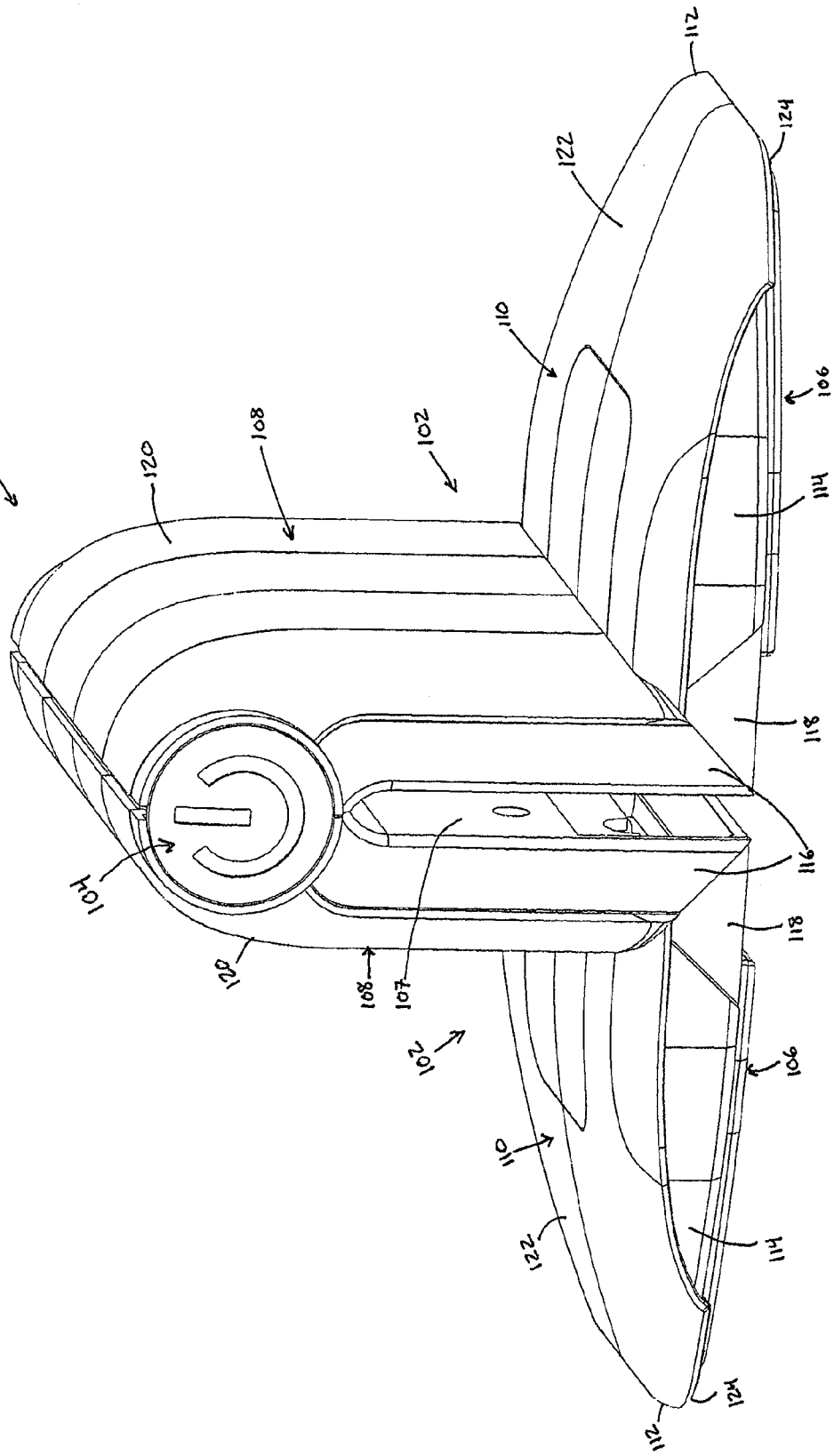
FIG. 3 shows a perspective view of an embodiment of the present invention in an ironing position in accordance with an embodiment of the present invention.
Figure 4:
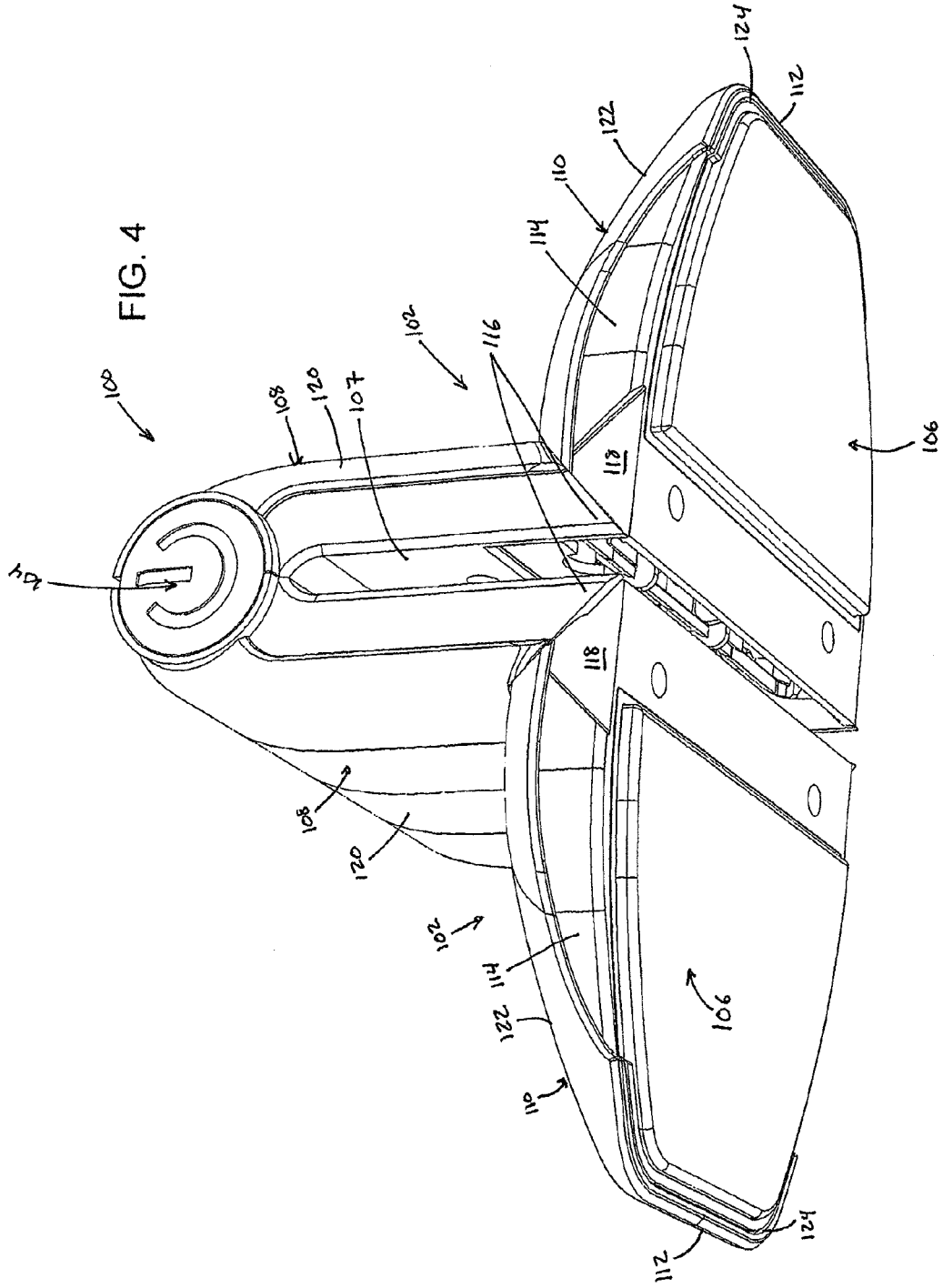
FIG. 4 shows another perspective view of the embodiment of FIG. 3 in accordance with an embodiment of the present invention.
Figure 5:
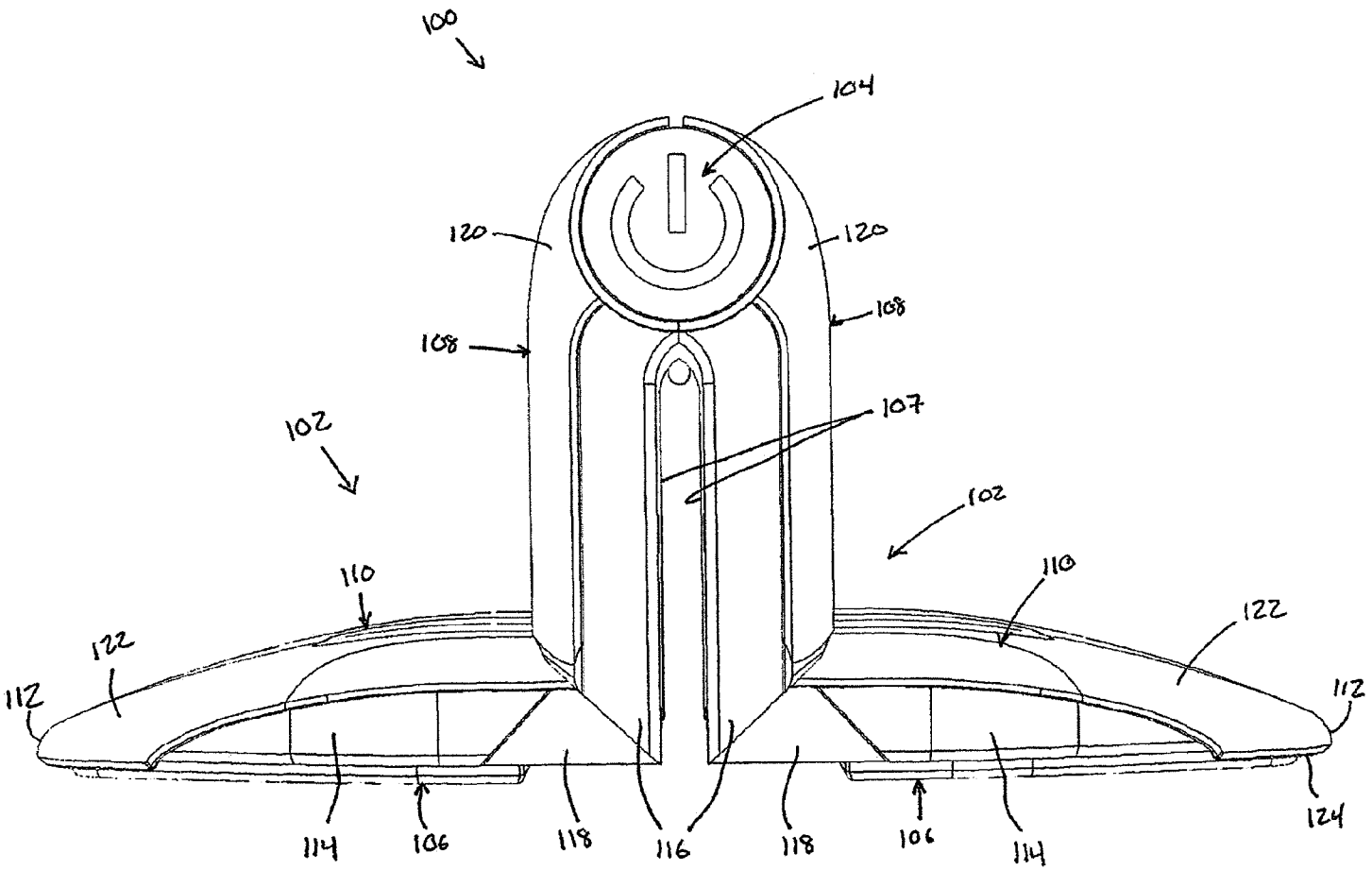
FIG. 5 shows a side view of the embodiment of FIG. 3 in accordance with an embodiment of the present invention.

With reference to FIGS. 3-5, an embodiment of the convertible iron 100 is shown in the ironing position. As detailed above, in some embodiments, the lower portions 110 of the wings 102 pivot relative to the upper portions 108. In these embodiments, the ironing position may be defined when the lower portions 110 are substantially perpendicular to the upper portions 108, such that the lower portions are substantially coplanar. As shown in FIGS. 3-5, the lower portions 110 may hold the heating plates 106 in substantially the same plane so that the heating plates may simultaneously iron the surface of a garment in a similar fashion to a traditional iron.

As detailed below, the joint between the upper 108 and lower 110 portions may include a locking hinge, two position hinge, or other similar mechanism for maintaining the lower portions in the ironing and detailing positions. In this configuration, both of the heating plates 106 may be oriented in the same direction to combine their effective surface areas to iron larger surfaces. In the ironing position, a user may grasp the upper portions 110 of the wings 102 and iron the garment or other article by applying heat and pressure opposite an ironing board or other similar surface.

In some alternative embodiments, the wings may define a single, rigid structure, such that the wings pivot between the ironing and detailing positions about the hub. In these embodiments, the heating plates 106 may substantially cover the entire ironing surface of the wing 102.

In the embodiments discussed herein, the heating plates 106 may protrude slightly from the wings 102 to allow the plates clearance to engage the garment. As detailed below, the heating plates 106 may also be floating relative to the wings 102, for example, on one or more springs 154 (shown in FIG. 9), and having a slight offset between the inner, ironing side of the wings 102 and the heating plates 106 may allow the plates to deflect inwardly during normal operation.

In some embodiments, the structure of the wings 102 may further be configured to improve the performance of the heating plates 106. For example, a mid-section of the ironing side of the wings 114 across both the lower 110 and upper 108 portions may be inset to allow maximum clearance of the garments coming into contact with the heating plates 106. In some embodiments, the outer shell 120, 122 of the respective upper 108 and lower 110 portions may be insulated or shielded to protect the user and nearby surfaces from the heat of the heating plates 106. The outer shell 120, 122 may overhang the ironing surface near the distal end 112 of the lower portion 110 to protect the user and external surfaces from accidentally contacting the heating plates 106 at the distal end. Additionally, or alternatively, the distal end 112 of the lower portion 110 may be chamfered towards the heating plates 106 to allow the garment or other article to smoothly feed into the heating plates. The outer surface 122 of the distal end 112 may further be tapered, such that the thickness of the wings 102 at the distal end narrows and may be received in small openings of the articles to be ironed (e.g., a lapel or between buttons).

Referring to FIGS. 1-5, the wings 102 may include one or more gap closers 116 that conceal the internal components of the convertible iron 100. The gap closers 116 may be disposed on the upper portion 108 of the wings 102 and may overlap a recessed portion 118 of the lower portion 110 in the detailing position, such that the upper portion and the lower portion also conceal the internal components of the iron in the ironing position. The gap closers 116 may additionally or alternatively be disposed on the lower portion 110.

FIG. 6 shows an additional, detailed view of a convertible iron 100 according to the present invention. Embodiments of the convertible iron 100 may include a power cord 128 and/or power button 130 in the hub 104 to control operation of the iron. Additionally or alternatively, the convertible iron 100 may include a lock button to lock the rotation of the hub 104 and/or lower portions 110.

In some embodiments, as shown in FIG. 6, the convertible iron 100 may include an indicator panel 126 covered by a transparent panel having various indicators that may illuminate to represent different modes of the iron. For example, with reference to FIG. 6, the indicator panel 126 may include a variety of fabric types, such as linen, denim, cotton, wool, silk, and poly corresponding to the proper temperatures for each type of fabric. The cloth types may sequentially increase in temperature from the most delicate cloth (e.g., requiring the lowest temperature) to the most robust cloth (e.g., allowing the highest temperature). For example, the iron 100 may provide incremental temperature options of 250, 300, 350, 400, and 450 degrees Fahrenheit corresponding to the respective ironing temperatures of each fabric.

In some embodiments, multiple indicators on the indicator panel may represent the same temperature. This may be used, for example, in cases where two different types of cloth require the same temperature setting. In these situations, it may be more confusing to omit a certain type of fabric because a user may not know which fabrics share a common ironing temperature. For example, if Denim and Cotton require the same ironing temperature, each of the Denim and Cotton modes and indicators may represent the same temperature despite being separate selectable settings. Alternatively, multiple indicators may simultaneously illuminate if multiple fabric types require the same temperature. In some alternative embodiments, the indicator panel 126 may include temperatures or intensity levels. The indicator panel 126 may additionally or alternatively include illuminating bars that may increase in width relative to each other to represent higher temperature settings.

In some embodiments, the temperature may be controlled by repeatedly pressing the power button 130 to cycle between modes of operation. The modes may further include an "OFF" mode in which the device does not heat. The iron 100 may also include an idle mode or safety timer that turns the device off after, for example, five, ten, or fifteen minutes of inactivity. Embodiments of the convertible iron may have separate indicators representing when the device is warming up or cooling down, or the existing indicators may flash, blink, or otherwise indicate when the device is warm but not ready for use.

Figure 7:
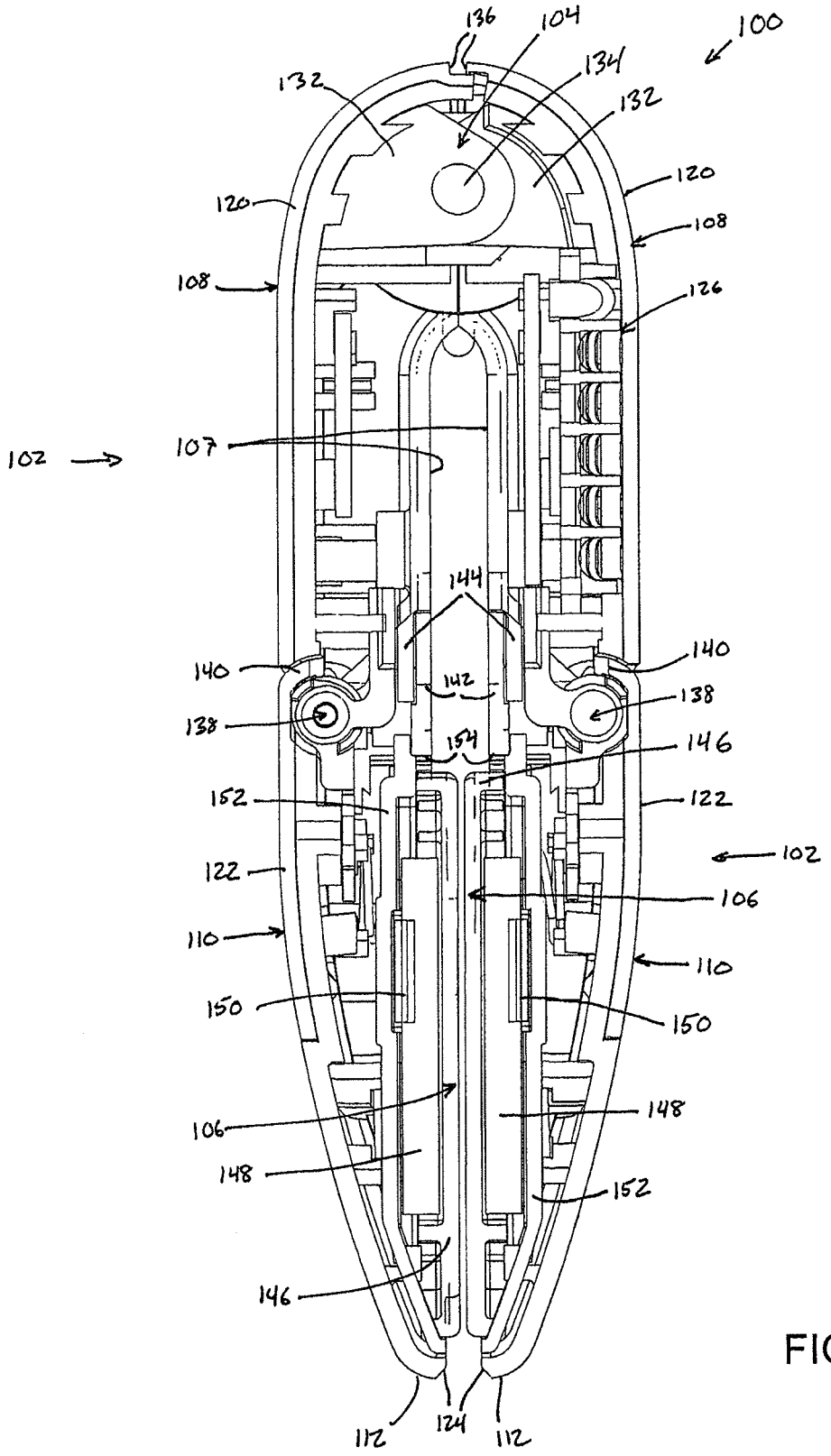
FIG. 7 shows a cross sectional view of the embodiment of FIG. 1 in accordance with an embodiment of the present invention.
Figure 8:
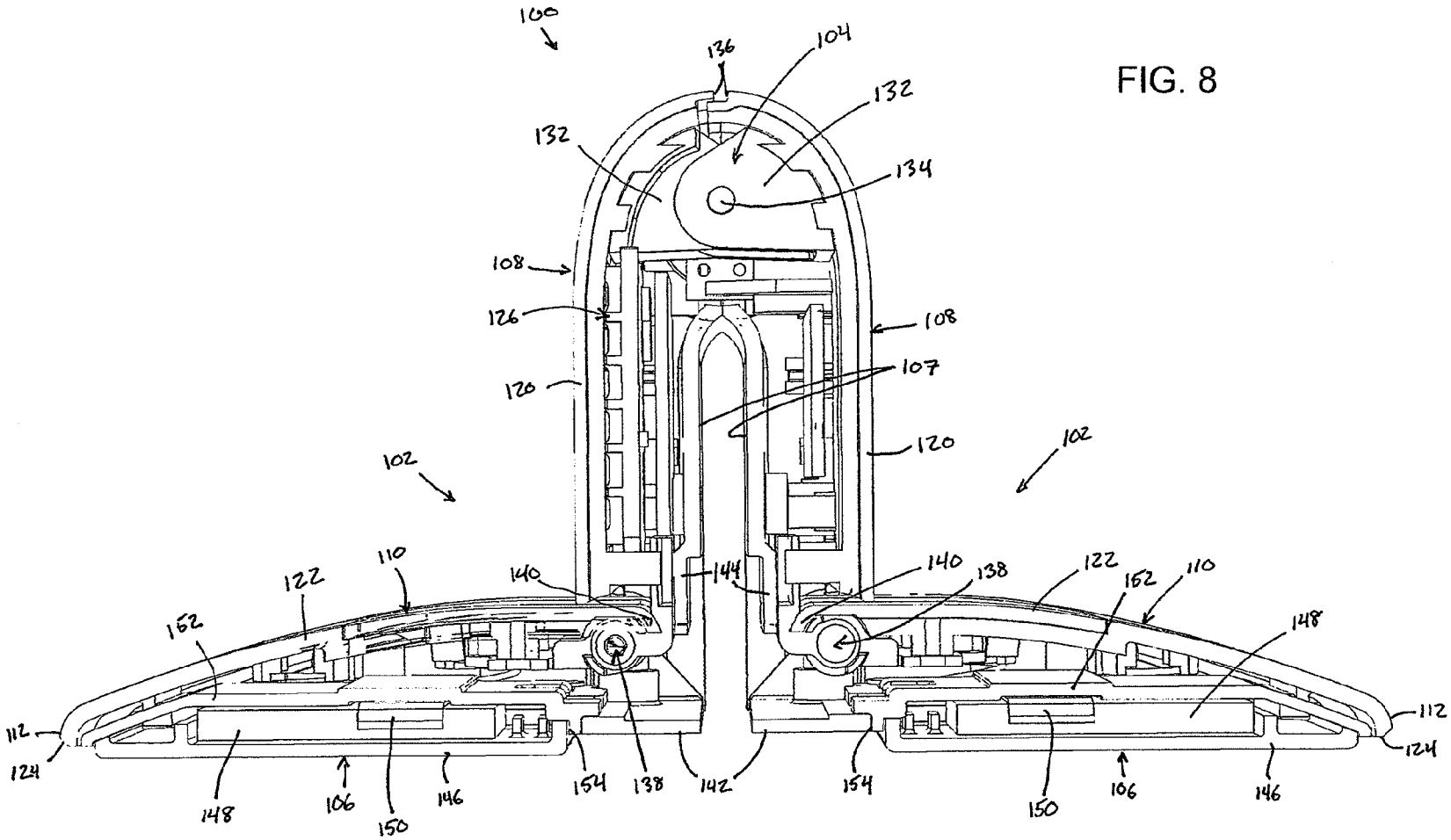
FIG. 8 shows a cross sectional view of the embodiment of FIG. 3 in accordance with an embodiment of the present invention.

Turning to FIGS. 7 and 8, cross-sectional views of the convertible iron 100 in the detailing and ironing positions are respectively shown. With reference to the hub 104, each wing 102 may include a hinge member 132 that is joined with a corresponding hinge member of the other wing by a pin 134 that allows the wings to pivot. The wings 102 may further surround the hub 104 and include engaging surfaces 136 that limit the range of motion of the wings. The engaging surfaces 136 may be configured to contact one another on the far side of the hub to stop the rotation of the wings 102 about the hub 104 at a predetermined range of motion (e.g., twelve degrees). The hub 104 may additionally or alternatively include a locking mechanism for maintaining the wings 102 in an open or closed position.

The wings 102 may include a hinge 138 connecting the upper portion 108 and the lower portion 110. The hinges 138 may enable the wings 102 to rotate between the detailing position and the ironing position. As detailed below, the hinges 138 may be locking hinges that lock the wings 102 in the detailing or ironing position. Alternatively, the hinges may be two position hinges that maintain the wings 102 in the detailing or ironing position, but allow the hinges to rotate upon application of sufficient force without being separately locked and unlocked.

The hinges 138 may be disposed within the wings 102, such that the outer shell 122 of the lower portion 110 pivots an upper edge 140 into the upper portion 108 when the lower portion rotates from the detailing position to the ironing position. Similarly, the inside surface 107 of the wings 102 may include an upper edge 142 on the lower portion 110 that overlaps a lower edge 144 on the upper portion in the detailing position such that the lower edge of the upper portion and the upper edge of the lower portion at least partially conceal the internal components of the iron when folded into the ironing position.

With continued reference to FIGS. 7 and 8, the heating plates 106 may comprise a conductive plate 146 coupled to a heating element 148. In some embodiments, a strap 150, adhesive, or other fastening member may be used to attach the heating element 148 to the conductive plate 146. The heating plate 106 may further include a sled 152 configured to hold the conductive plate 146 and heating element 148. The sled 152 may be larger than an opening 154 in the inside surface 107 of the wing 102 to maintain the heating plate in the wing. The sled 152 may be configured to support the conductive plate 146 such that the heating plate 106 protrudes from the wing 102 but cannot fall out. The conductive plate 146 may protrude from the ironing surface 107 by approximately ¼ inch. The conductive plate 146 may be substantially smooth. In some embodiments the conductive plate 146 may include one or more holes therein for administering steam to the articles.

Figure 9:
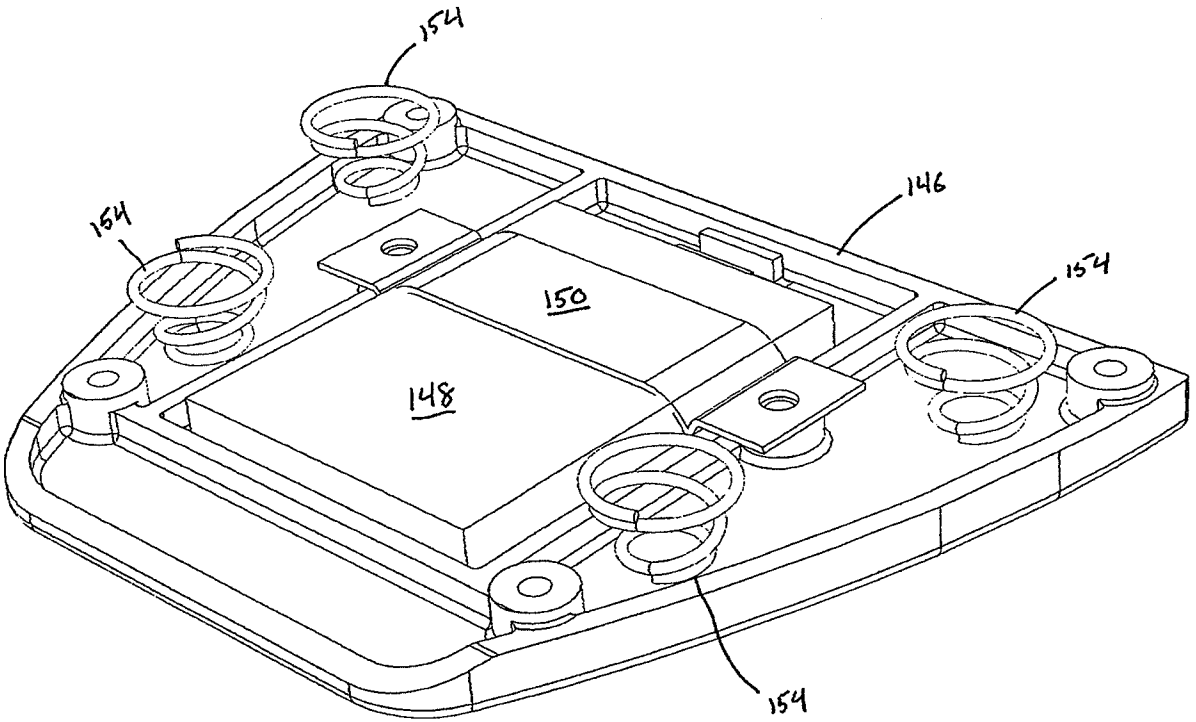
FIG. 9 shows a partial perspective view of a heating plate having a sled removed in accordance with an embodiment of the present invention.
Figure 10:
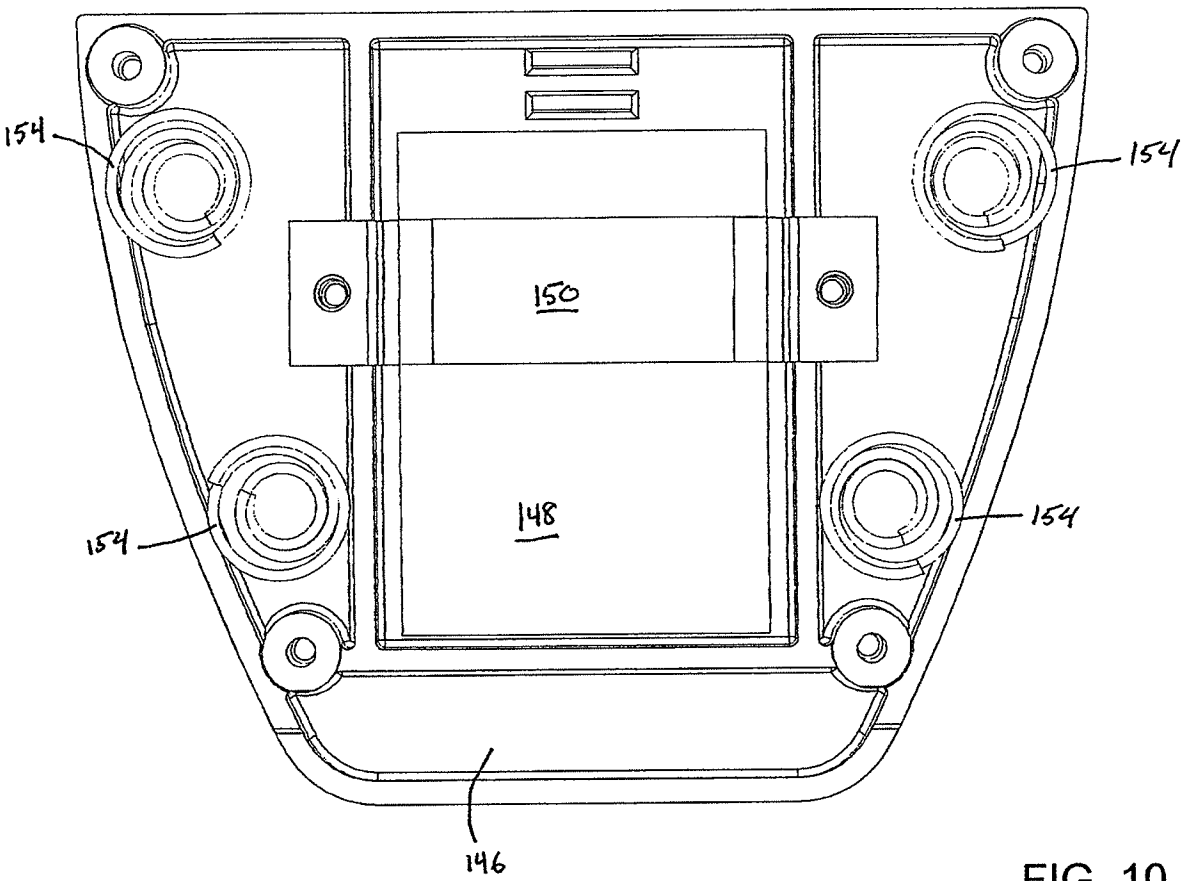
FIG. 10 shows a partial top plan view of the heating plate of FIG. 9 in accordance with an embodiment of the present invention.

Turning to FIGS. 9 and 10, a heating plate 106 is shown having the sled 152 removed. As discussed herein, the heating plate 106 may be supported by one or more springs 154 that allow the heating plate and the sled 152 to float within the wings 102. In combination with the sled 152 (shown in FIGS. 7-8), the springs 154 may allow the heating plate 106 to absorb minor imperfections in the garment or other article, while the sled maintains the heating plate in the wings 102. The springs 154 may attach to an inner surface of the shell 122 of the convertible iron. In some alternative embodiments, one or more of the heating plates (or non-heating surfaces described above) may be fixed with respect to the wings 102.

With reference to FIGS. 11-15, embodiments of a hinge 138 are shown. The hinge 138 may include one or more upper arms 156, 158 and one or more lower arms 160. The upper arms 156, 158 may be connected to the upper portion 108 of the wing 102, and the lower arms 160 may be connected to the lower portion 110 of the wing. The upper 156, 158 and lower 160 arms may be joined at and pivot about a hinge pin 162. The range of motion of each hinge 138 may be determined by one or more protrusions 164 on either the upper or lower arms that limit the rotation of the hinge arms.

Figure 11:
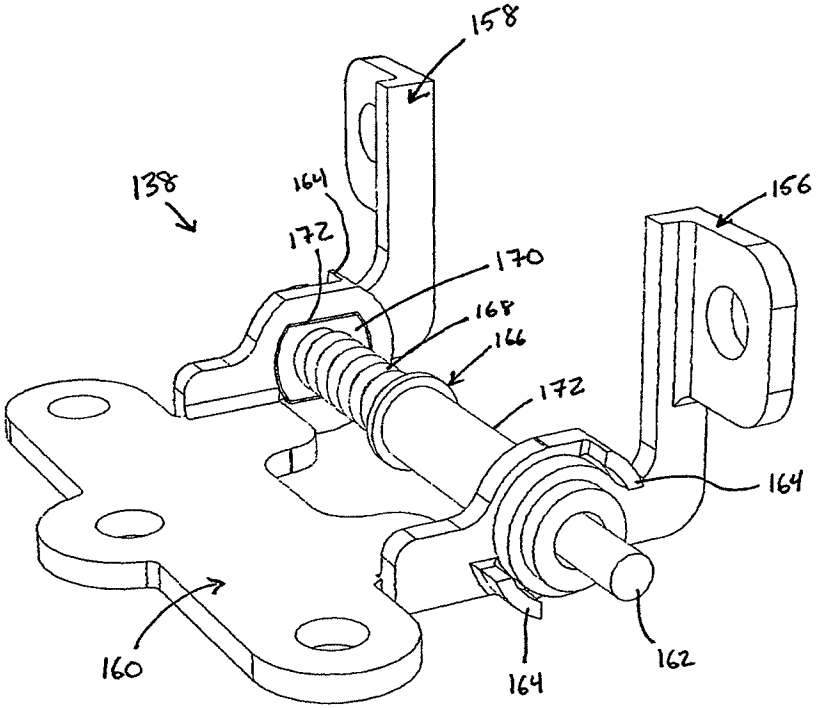
FIG. 11 shows a perspective view of a hinge in an ironing position in accordance with an embodiment of the present invention.

For example, FIG. 11 shows a hinge 138 in accordance with some embodiments of the present invention in the ironing position. In the ironing position, a protrusion 164 on the lower arm 160 may contact the top of the upper arms 158 to prevent the lower arm from pivoting further clockwise.

Figure 12:
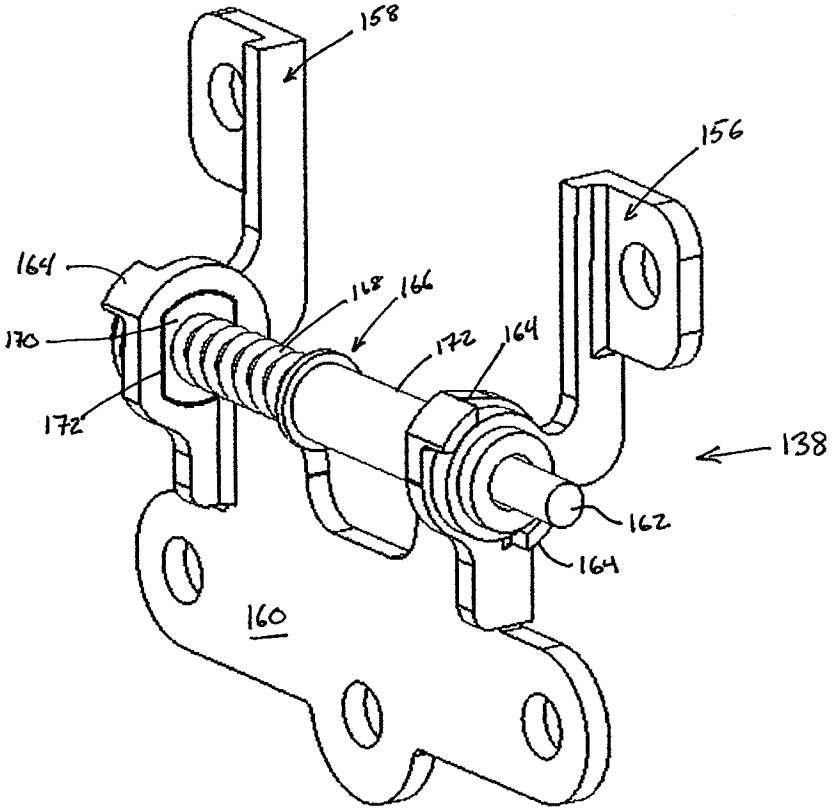
FIG. 12 shows a perspective view of the hinge of FIG. 11 in a detailing position in accordance with an embodiment of the present invention.
Figure 13:
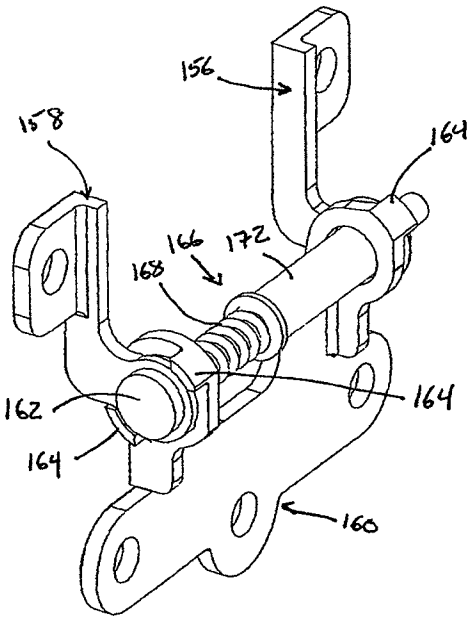
FIG. 13 shows another perspective view of the hinge of FIG. 11 in a detailing position in accordance with an embodiment of the present invention.

Similarly, FIG. 12 shows a hinge 138 in the detailing position. In the detailing position, a protrusion 164 on the lower arm 160 may contact the bottom of the upper arms 158 to prevent the lower arm from pivoting further counter-clockwise. Alternatively, the protrusions 164 may be disposed on the upper arms 156, 158 and may instead be configured to contact the lower arm 160.

In some embodiments, the hinge 138 may be a multi-position hinge (e.g., a two-position hinge) that includes a positioning mechanism 166 that maintains the hinge 138 in either the detailing position or the ironing position. The two position hinge 138 may allow a user to rotate the lower portion 110 of the wing 102 with sufficient application of force, but may otherwise maintain the lower portion 110 in one of a plurality of predetermined positions. For example, the positioning mechanism 166 may apply enough of a locking force that the lower portion 110 does not rotate with respect to the upper portion 108 when the user pinches the garment or other article in the detailing position. The positioning mechanism 166 may, nonetheless, not lock the hinge 138 completely, such that a user can still rotate the lower portion 138 without having to separately unlock the hinge.

Figure 14:
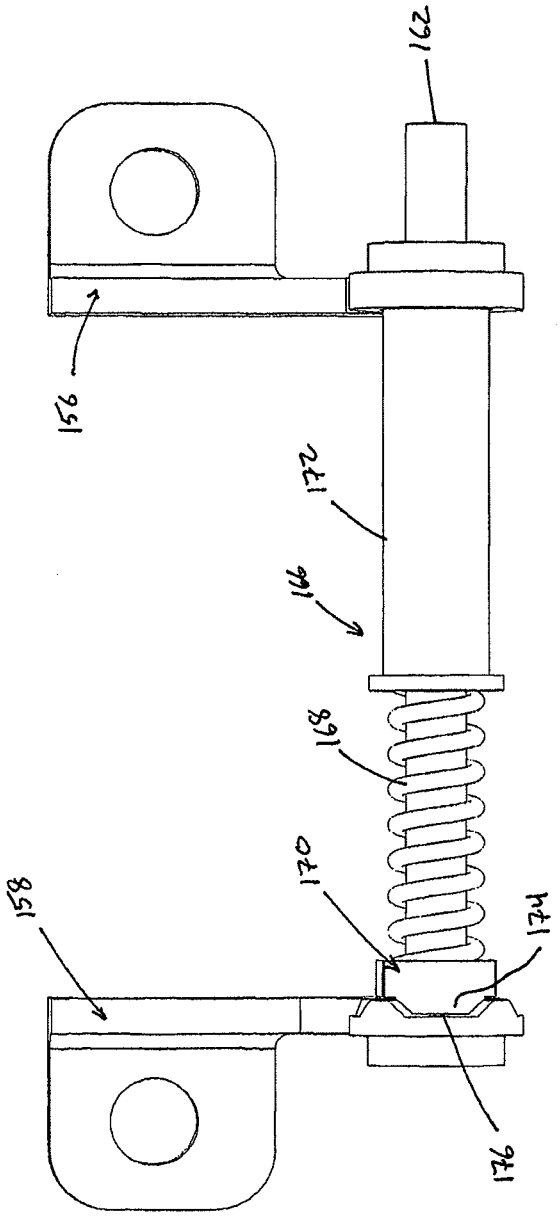
FIG. 14 shows a partial top plan view of a hinge in accordance with an embodiment of the present invention.
Figure 15:
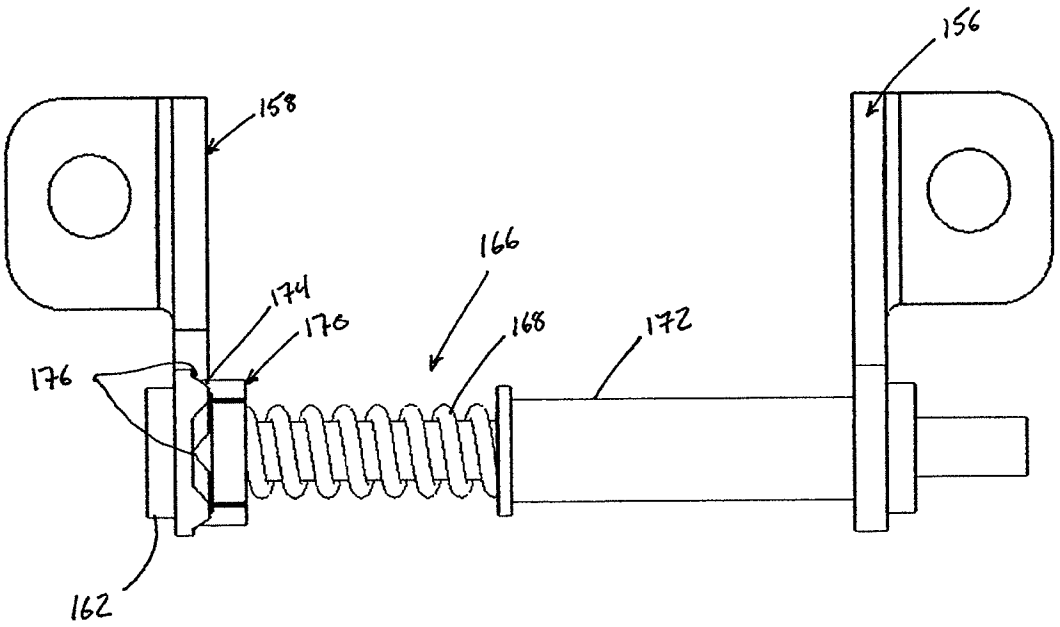
FIG. 15 shows a partial top plan view of the hinge of FIG. 14 in accordance with an embodiment of the present invention.

The positioning mechanism 166 may include a spring 168 and detent plate 170 disposed about the hinge pin 162. A sleeve 172 may also be disposed about the pin 162 to provide a surface for the spring 168 to engage, as shown in FIG. 11. In some embodiments, the lower arm 160 or upper arm 156, 158 of the hinge 138 may include a receiving slot 172 for engaging the detent plate 170. The receiving slot 172 may rotate the detent plate 170 as the hinge 138 rotates between the detailing position and the ironing position. The detent plate 170 may include one or more teeth 174, which may engage corresponding grooves 176 in at least one of the lower 160 or upper 156, 158 arms. The spring 168 may bias the detent plate 170 into the grooves 176. In this manner, the number of positions at which the teeth 174 engage the grooves 176 defines the number of positions available to the hinge 138. For example, a two position hinge may include at least two positions disposed approximately ninety degrees apart in which the teeth 174 engage a corresponding groove 176. With reference to FIGS. 14 and 15, a positioning mechanism 166 and upper arms 156, 158 are shown having the lower arm 160 removed. In FIG. 14, the teeth 174 of the detent plate 170 engage the grooves 176 of the upper arm 158 at approximately a horizontal position. As compared with the embodiment of FIG. 14, FIG. 15 depicts the teeth 174 of the detent plate 170 engaging the grooves 176 of the upper arm 158 at approximately a vertical position. The horizontal and vertical engagement positions may each correspond to one of the detailing and ironing positions of the lower portion 108. Any number of teeth and grooves may be used to allow for the desired number of possible positions. As shown in FIG. 15, the teeth may span the entire detent plate 170, so that the teeth engage the grooves 176 on either side of the hinge pin 162.

Alternatively the hinge may be a locking hinge that includes a pin or latch configured to hold the hinge in the ironing or detailing position. In such an embodiment, a user may manually, or the device may automatically, engage and release the rotation of the lower portion 110 of the wing 102 with respect to the upper portion 108.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

The invention claimed is:

1. A convertible iron comprising:

a first adjustable wing and a second adjustable wing;

a pivoting hub, wherein each of the adjustable wings is joined to the pivoting hub, the adjustable wings being configured to pivot about the hub and with respect to each other; and a heating plate connected to at least the first adjustable wing, wherein at least a portion of each adjustable wing is configured to rotate between a detailing position and an ironing position;

wherein, in the detailing position, the portions of each adjustable wing are substantially parallel, such that the adjustable wings are substantially opposing one another and are configured to receive an article therebetween for ironing;

wherein, in the ironing position, the portions of each adjustable wing are substantially coplanar and are configured to engage a same side of a surface of an article for ironing, and wherein at least the first adjustable wing comprises an upper portion pivotally connected to a lower portion, wherein the lower portion is the portion of the first adjustable wing that is configured to rotate between the detailing position and the ironing position.

2. The convertible iron of claim 1, wherein in the ironing position, the lower portion of the first adjustable wing is disposed perpendicular to the respective upper portion of the first adjustable wing.

3. The convertible iron of claim 1, wherein in the detailing position, the lower portion of the first adjustable wing is collinear with the respective upper portion of the first adjustable wing.

4. The convertible iron of claim 1, further comprising a hinge connecting the upper portion and lower portion of the first adjustable wing.

5. The convertible iron of claim 4, wherein the hinge is a two-position hinge adapted to allow a user to rotate the lower portion of the first adjustable wing between the detailing position and the ironing position.

6. The convertible iron of claim 1, wherein the heating plate is disposed in the lower portion of the first adjustable wing.

7. The convertible iron of claim 1, further comprising a second heating plate disposed in the second adjustable wing.

8. The convertible iron of claim 1, wherein each heating plate comprises a conductive plate and a heating element attached to the conductive plate.

9. The convertible iron of claim 1, further comprising at least one spring connecting each heating plate to the respective adjustable wing, such that the springs are configured to support each heating plate.

10. The convertible iron of claim 9, wherein the heating plate is substantially free floating within each respective wing, such that the heating plates are configured to conform to a contoured surface of the article.

11. The convertible iron of claim 1, further comprising an actuator connected to the heating plates, configured to be actuated by a user, and configured to select from a plurality of temperature settings of the heating plates.

12. The convertible iron of claim 1, wherein a distal end of the first adjustable wing comprises a chamfer configured to guide uneven surfaces towards the heating plate.

13. The convertible iron of claim 1, further comprising a heat shield disposed opposite the heating plate on the first adjustable wing.

14. The convertible iron of claim 1, wherein the adjustable wings are configured to pivot at least twelve degrees about the hub.

15. The convertible iron of claim 1, wherein the second adjustable wing comprises a second upper portion pivotally connected to a second lower portion, wherein the second lower portion is the portion of the second adjustable wing that is configured to rotate between the detailing position and the ironing position.

16. The convertible iron of claim 1, further comprising a first hinge connecting the upper portion and lower portion of the first adjustable wing and a second hinge connecting the second upper portion and second lower portion of the second adjustable wing, wherein in the ironing position, the first hinge and the second hinge are configured to be disposed proximate one another.

17. A method of manufacturing a convertible iron, the method comprising:

providing a first adjustable wing, a second adjustable wing, and a pivoting hub;

joining the first adjustable wing and the second adjustable wing to the pivoting hub, the first and second adjustable wings being configured to pivot about the hub and with respect to each other;

positioning a heating plate in at least the first adjustable wing, wherein at least a portion of each adjustable wing is configured to rotate between a detailing position and an ironing position;

wherein in the detailing position, the portions of each adjustable wing are substantially parallel, such that the adjustable wings are substantially opposing one another and are configured to receive an article therebetween for ironing;

wherein in the ironing position, the portions of each adjustable wing are substantially coplanar and are configured to iron a surface of the article, and wherein providing the first adjustable wing comprises pivotally connecting an upper portion of the first adjustable wing and a lower portion of the first adjustable wing, wherein the lower portion is the portion of the first adjustable wing that is configured to rotate between the detailing position and the ironing position.

18. The method of claim 17, further comprising attaching the heating plate to the first adjustable wing with at least one spring connection, such that the at least one spring connection is configured to support the heating plate.

19. The method of claim 17, wherein providing the second adjustable wing comprises pivotally connecting a second upper portion of the second adjustable wing and a second lower portion of the second adjustable wing, wherein the second lower portion is the portion of the second adjustable wing that is configured to rotate between the detailing position and the ironing position.

20. The method of claim 17, further comprising pivotally connecting the upper portion and lower portion of the first adjustable wing with a first hinge and pivotally connecting the second upper portion and second lower portion of the second adjustable wing with a second hinge, wherein in the ironing position, the first hinge and the second hinge are configured to be disposed proximate one another.

21. A method of converting a convertible iron, the convertible iron comprising a first adjustable wing; a second adjustable wing; a pivoting hub, wherein each of the adjustable wings is joined to the pivoting hub, the adjustable wings being configured to pivot about the hub and with respect to each other; and a heating plate connected to at least the first adjustable wing, the method comprising:

rotating at least a portion of each adjustable wing between a detailing position and an ironing position;

wherein, in the detailing position, the portions of each adjustable wing are substantially parallel, such that the adjustable wings are substantially opposing one another and are configured to receive an article therebetween for ironing;

wherein, in the ironing position, the portions of each adjustable wing are substantially coplanar and are configured to engage a same side of a surface of an article for ironing, and wherein at least the first adjustable wing comprises an upper portion and a lower portion, and wherein rotating at least a portion of the first adjustable wing between the detailing position and the ironing position comprises rotating the lower portion with respect to the upper portion.

22. The method of claim 21, wherein the second adjustable wing comprises a second upper portion and a second lower portion, and wherein rotating at least a portion of the second adjustable wing between the detailing position and the ironing position comprises rotating the second lower portion with respect to the second upper portion.

23. The method of claim 21, further comprising a first hinge connecting the upper portion and lower portion of the first adjustable wing and a second hinge connecting the second upper portion and second lower portion of the second adjustable wing, wherein in the ironing position, the first hinge and the second hinge are configured to be disposed proximate one another.

* * * * *